US006776300B2

(12) United States Patent
Walsh et al.

(10) Patent No.: US 6,776,300 B2
(45) Date of Patent: Aug. 17, 2004

(54) COLLAPSIBLE CONTAINER WITH CLOSED, MULTI-PANELED SIDEWALLS

(75) Inventors: Thomas Walsh, University Place, WA (US); Joe Oates, Tacoma, WA (US); Yiyun (Sherri) Culp, Witchita, KS (US)

(73) Assignee: Xytec Systems, Inc., DE (US)

( * ) Notice: Subject to any disclaimer, the term of this patent is extended or adjusted under 35 U.S.C. 154(b) by 0 days.

(21) Appl. No.: 09/828,036

(22) Filed: Apr. 6, 2001

(65) Prior Publication Data

US 2002/0070215 A1 Jun. 13, 2002

Related U.S. Application Data

(60) Provisional application No. 60/196,040, filed on Apr. 7, 2000.

(51) Int. Cl.[7] ..... B65D 19/18
(52) U.S. Cl. ..... 220/6; 206/386
(58) Field of Search ..... 206/386, 600; 220/6, 7, 666, 1.5

(56) References Cited

U.S. PATENT DOCUMENTS 3,088,627 A * 5/1963 Saunders ..... 312/1
4,491,231 A 1/1985 Heggeland et al.
4,674,647 A 6/1987 Gyenge et al.
4,775,068 A 10/1988 Reiland et al.
4,967,927 A 11/1990 Reiland et al.
5,114,037 A 5/1992 Hillis et al.
5,161,709 A 11/1992 Oestreich, Jr.
5,199,592 A 4/1993 Reiland et al.
5,249,678 A 10/1993 Traina
5,289,935 A 3/1994 Hillis et al.
5,351,846 A 10/1994 Carter
5,474,197 A 12/1995 Hillis et al.
5,601,202 A * 2/1997 Meacham et al. ..... 220/6
5,788,103 A 8/1998 Wagner et al.
5,988,420 A 11/1999 Jacques et al.
6,283,319 B1 9/2001 Hillis et al.

* cited by examiner

*Primary Examiner*—Stephen Castellano
(74) *Attorney, Agent, or Firm*—Townsend and Townsend and Crew LLP

(57) ABSTRACT

A novel, collapsible container is provided which features container side walls and end walls that have a closed, multi-paneled element forming at least a portion of the wall. The closed wall element is formed from an exterior panel and an interior panel that are joined along top, side and bottom seams of the panel, preferably by hot plate welding, to form a closed, multi-paneled side or end wall element. In more detailed aspects of the invention, the side or end walls incorporate a windowed construction, which includes a window having a seam surrounding a single panel window area.

9 Claims, 9 Drawing Sheets

COLLAPSIBLE CONTAINER WITH CLOSED, MULTI-PANELED SIDEWALLS

CROSS-REFERENCES TO RELATED APPLICATIONS

This application claims the benefit of U.S. Provisional Patent Application No. 60/196,040, filed on Apr. 7, 2000, the disclosure of which is incorporated by reference.

BACKGROUND OF THE INVENTION

The present invention relates to side wall components for reusable, industrial shipping and storage containers. In particular, the invention relates to side wall components for use with collapsible shipping and storage containers.

Various reusable shipping and storage containers are known in the art that are adaptable for general industrial and agricultural uses, including storage and transport of manufacturing tools and parts, packaged goods, and bulk commodities. Such containers range in size from large capacity cargo containers to smaller and lighter-weight containers designed for such commodities as bakery goods and farm produce.

Among these different commercial container designs, collapsible containers that have foldable side walls and end walls for compact storage and transport of the containers when emptied are well known in the art. A number of these containers are designed with pallet-type bases and upright container walls that are pivoted to the base. The walls and base are adapted to permit the walls to be pivotally erected on the base to a locked, upright position during use, and later collapsed into a folded position against the upper surface of the base for return transport or storage.

Exemplary among the foregoing types of containers are the container designs set forth in U.S. Pat. No. 4,674,647, issued Jun. 23, 1987 to Gyenge et al., U.S. Pat. No. 4,775,068, issued Oct. 4, 1988 to Reiland et al., U.S. Pat. No. 4,967,927, issued Nov. 6, 1990 to Reiland et al.; U.S. Pat. No. 5,199,592, issued Apr. 6, 1993 to Reiland et al.; U.S. Pat. No. 5,474,197, issued Dec. 12, 1995 to Hillis et al.; U.S. Pat. No. 5,788,103, issued Aug. 4, 1998 to Wagner et al.; and U.S. patent application Ser. No. 08/567,385, filed Dec. 4, 1995, by Hillis et al. and identified by (each of the foregoing patent documents are incorporated herein by reference in their entirety for all purposes).

Collapsible containers are typically formed from injection-molded plastics, for example high-density polyethylene. A principal obstacle encountered with previous molded plastic containers for heavy industrial and agricultural purposes has been the difficulty in providing foldable walls which, when erected, are strong enough to carry heavy loads such as machine parts or heavy metal objects, as well as large volumes of farm produce, meat and other heavy food items. The use of such reinforcing devices as metal clips, hinge pins, struts, beams and other reinforcing members to add strength and durability to the container walls and hinge elements is undesirable. In particular, such metal parts may become separated and lost when the container is collapsed for return shipment. In addition, such designs involve the use of separate or compound parts made of diverse materials, which are prohibitively expensive to manufacture and would render the containers too cumbersome to be practical. Other considerations such as replacement of worn out parts and the ability to keep the container structure clean, further detract from the use of such reinforcing members.

In order to accommodate the heavy load requirements of industrial and agricultural, collapsible containers, the stiffness and strength of the base and side walls have typically been reinforced by adding support elements, such as support beams, struts and waffle plates, integrally molded in the base and side walls of the container. Examples of ribbing and beam patterns that have been used to reinforce bases and side walls of collapsible containers are provided in U.S. Pat. No. 4,674,647, issued Jun. 23, 1987 to Gyenge et al; U.S. Pat. No. 4,775,068, issued Oct. 4, 1988 to Reiland et al; and U.S. Pat. No. 5,114,037, issued May 19, 1992 to Hills et al. (each incorporated herein by reference).

Although these reinforcement techniques produce high strength collapsible containers with large load capacities, they have several disadvantages for containers used to transport and store foodstuffs and other goods that are vulnerable to mechanical damage and/or contamination. In this context, container designs that feature reinforcing beams, ribbing or waffle plates for shipping and storing agricultural products tend to become clogged with grime, dirt, or crushed produce. This raises substantial problems with respect to food sanitation. Likewise, ribbed or waffled support surfaces can impart harmful contaminants to other sensitive products, including fine machine parts and goods packaged for retail sale. To compound these deficiencies, ribbed and waffled support surfaces of previously known collapsible containers have numerous comers, angles, ridges and recesses that are difficult to reach with detergents and antiseptics and to flush clean after use.

More recent efforts to develop high strength collapsible containers for transport and storage of foodstuffs and other goods subject to damage and contamination have been directed toward providing smooth base and side wall surfaces. For example, U.S. Pat. No. 5,788,103, issued Aug. 4, 1998 to Wagner et al., describes a collapsible container with smooth base and side wall surfaces that reduce contamination and improve cleaning ability. However, the side walls incorporate vents and vertical strut elements that still provide undesirable niches for contaminants to accumulate and barriers that reduce penetration of cleansers and flushing liquids.

Accordingly, there is an unmet need in the art for a collapsible container having side walls which can support heavy loads of agricultural and industrial goods materials, but which minimizes the risk of contamination of these materials when transported or stored in the container.

In addition, there is a need in the art for a collapsible container for heavy agricultural and industrial use which can be thoroughly surface-exposed after use to detergents and decontaminating agents and flushed free of contaminants and cleansing agents for safe reuse.

It is therefore an object of the instant invention to provide a collapsible container having a new and improved construction that minimizes exposed structural elements and support surfaces for sanitary purposes, but which nonetheless provides sufficient structural support for heavy agricultural and industrial use.

It is a related object of the invention to provide such a container which incorporates side and end walls having a minimal exposed surface area and which eliminates unnecessary comers, angles, recesses and other niches where grime and pathogenic agents can be deposited and retained to impose unacceptable contamination risks to food and other sensitive articles placed in the container.

It is a further object of the invention to achieve the above objects in a collapsible container that provides for improved access to the contents of the container when access through the top is impractical, such as when the top is covered, when the containers are stacked, or when the container is at an elevation to make access through the top opening impractical. Toward this end, it is an object of the invention to provide a collapsible container having an opening in a container side wall that is closeable with a hinged gate, wherein the side wall and gate satisfy the above needs of providing sufficient strength and support while minimizing exposed support surfaces prone to contamination.

The instant invention satisfies the foregoing needs and fulfills additional objects and advantages that will become apparent from the description which follows in conjunction with the accompanying drawings.

SUMMARY OF THE INVENTION

In brief summary, the instant invention provides a novel, collapsible container which includes a container base joined to an upright opposing pair of side walls and opposing pair of end walls. Each of the side walls and end walls have a novel, closed, multi-paneled element forming at least a portion of the wall, which is formed from an exterior panel and an interior panel that are joined along top, side and bottom seams of the panel, preferably by hot plate welding, to form a closed, multi-paneled side or end wall element.

In more detailed aspects of the invention, the side or end walls incorporate a novel windowed construction, which includes a window with a seam surrounding a single panel window area.

In other detailed aspects of the invention, the collapsible container features at least one of the top, side and bottom seams of the side or end wall is a flashless seam.

In certain embodiments of the invention, the collapsible container of the invention incorporates a hinged access door having a closed, multi-paneled construction.

In additional embodiments, the collapsible container includes a multi-part forklift strap attached to the container base. The forklift strap preferably includes two interchangeable strap halves. The interchangeable strap halves feature interlocking dovetail connector ends having opposing faces that feature multiple, differently drafted surfaces.

In yet additional aspects of the invention, a collapsible container is provided which incorporates a novel, floating cantilever hinge design for interlocking the side and end walls to the base. Other hinge designs provided within the invention include hinges that incorporate self-bailing hinge pockets.

In related aspects of the invention, methods for producing a side or end wall for a collapsible container are provided which include steps of separately molding container side wall and end wall exterior and interior panels, and subsequently welding the panels along top, side and bottom seams to form a closed side wall structure.

DESCRIPTION OF THE SPECIFIC EMBODIMENTS

Figure 1:
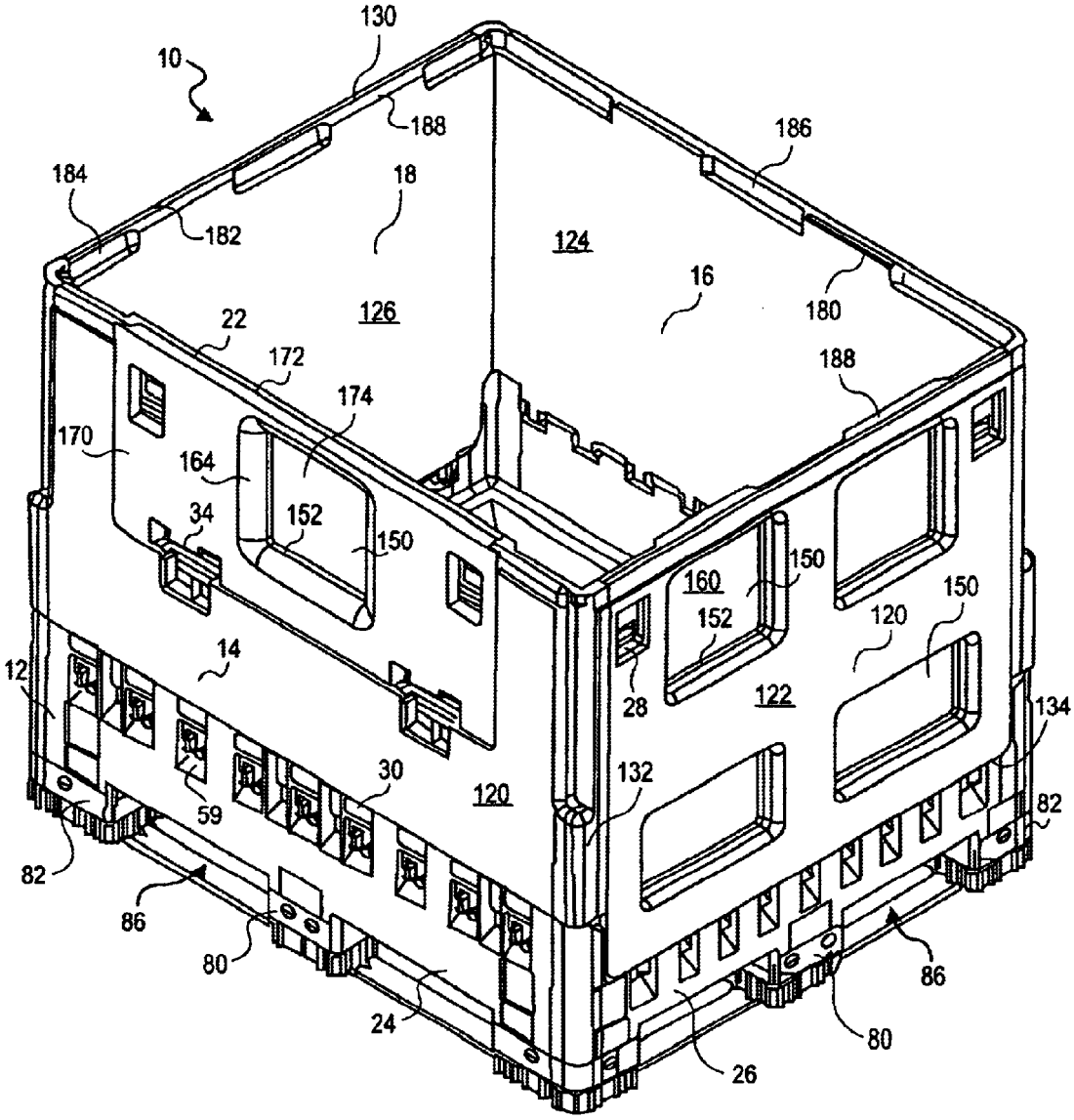
FIG. 1 is a perspective view, illustrating a container constructed according to the concepts of the invention.

As illustrated in FIG. 1, the instant invention provides a novel, collapsible container 10 for use in transporting and storing heavy agricultural and other food items, as well as other industrial and consumer articles and goods for which clean or sanitary handling conditions are desired. The container features a pallet-type base 12 which supports four vertical panels or walls pivotally connected to the base. For ease of description, these walls are referred to herein as first and second side walls 14, 16, and first and second end walls 18, 20, respectively, although the terms "wall" or "side wall" can be applied to any of these vertical wall structures generically.

The container 10 of the invention can be made from a wide range of materials using a variety of fabrication methods known in the art. Preferably, the various components of the container are manufactured at least in part by injection-molding of a thermoplastic material, of which many different types and compositions are known and readily available in the art for use within the methods and products of the invention. In preferred embodiments, a high-density polyethylene material is used to injection-mold individual components of the container, including component panels of the side wall (see below).

In the exemplary embodiment of the invention depicted in FIG. 1, the side and end walls of the container are non-integral with respect to each other, preferably being separately molded, and are also non-integral with respect to the base. Also as shown in FIG. 1, the side walls 14, 16 are shorter in height (i.e., from the base to a top edge 22 of the wall) than the end walls 18, 20 and are coupled to a base side wall 24 that is commensurately taller in height than a base end wall 26—so that the top edges 22 of the container side and end walls are flush with one another when the walls are erected and interlocked. By virtue of this design, the side and end walls are positioned on the base and dimensioned for semi-sequential folding, as described in the above incorporated priority disclosures. Briefly, the taller, end walls 18, 20 have pivot axes extending across the bin in a horizontal direction and at an elevation which is slightly above the elevation of the floor of the container defined a planar top surface of the base. This organization permits the end walls to be collapsed by pivoting from an upright configuration depicted in FIG. 1 to a collapsed configuration with the first and second end walls lying adjacent the base portion, with one wall overlapped and folded over the other wall. In the case of the side walls 14, 16, the pivot axes for the walls extend horizontally across the bin at a slightly higher elevation than the axes for the end walls. This enables the side walls to be folded from the upright configuration depicted in FIG. 1 to a collapsed configuration to lie on top of the previously-folded side walls, to provide a compact and more easily transported container for storage or return (empty) shipment. Side and end walls which are similarly designed for semi-sequential folding to a collapsed state are disclosed in U.S. Pat. No. 4,674,647 incorporated herein.

In preferred embodiments of the invention, the side and end walls are interconnected along adjacent side edges with the walls in an upright position by a joint which is effective to hold the walls upright and prevent them from pivoting outwardly from a vertical, as described in the incorporated priority disclosures. The side edges of the walls may also be interlocked by the same or different cooperative joint means to prevent relative longitudinal displacement. A latch mechanism 28 is provided at each of the corners of the bin 10 for latching adjacent edges, whereby an end wall is held from pivoting inwardly from an upright position. An exemplary latch mechanism for use within the invention is described in the incorporated U.S. Pat. No. 4,775,068.

Figure 2:
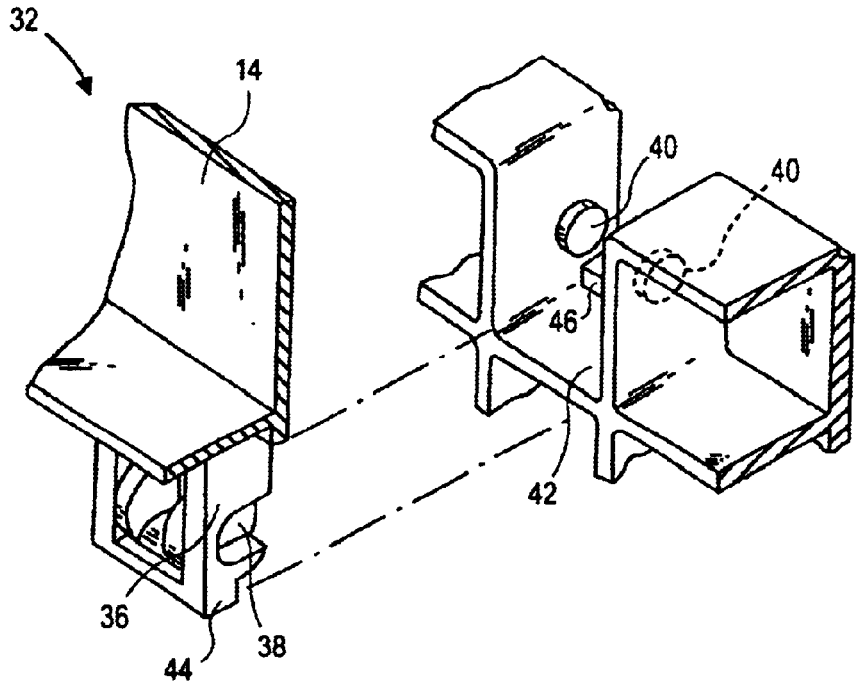
FIG. 2 is an exploded view of a standard hinge for use within containers of the invention.

A number of types of hinges 30 can be used to provide a pivotal connection between the base 12 and the side walls 14, 16 and end walls 18, 20 of the container 10. Typically, a battery of 2–4, often 6–9 or more, hinges is provided between each of the walls and the base to add strength and stability to the container. In preferred embodiments, two types of hinges are provided, a simple pivot hinge 32 and a spring-mounted or "snap-hinge" 34, as exemplified in FIGS. 2 and 3, respectively. Each of the hinges 32, 34 is molded integrally with its respective side or end wall panel, obviating the need for any special hardware or removable parts. The simple hinge 32 structure is exemplified by the illustration in FIG. 2, which features a rectangular hinge body 36 extending from the bottom edge of the associated side or end wall with the inner face thereof being flush with the inside surface of the associated wall. Although the detailed configuration of the hinge body may very somewhat, each of the side walls of the simple hinge body is provided with an elongated slot 38 which together engage bosses or cylindrical protrusions 40 formed on side walls of a U-shaped opening 42 in the associated base side wall 24 or end wall 26. It will be noted that the slots are open ended on the inward side thereof to permit the hinge 32 to be inserted into the U-shaped opening with the slots engaged with the bosses 40 in a lateral direction. The hinge body 36 preferably closely conforms to the configuration of the opening 40 so as to substantially close the opening when the side wall is in place. The body also includes a downwardly extending protrusion 44 which engages a shoulder 46 in the bottom of the U-shaped opening 42. The simple hinge 32 thus provides a pivot or hinge point about the axis of the bosses 40 when the side wall is folded inwardly. The protrusion 44 and the shoulder 46 prevent the side wall from being pivoted outwardly beyond the vertical and also provide protection for the hinge in the event of any lateral impact on the outside wall of the container.

Figure 3:
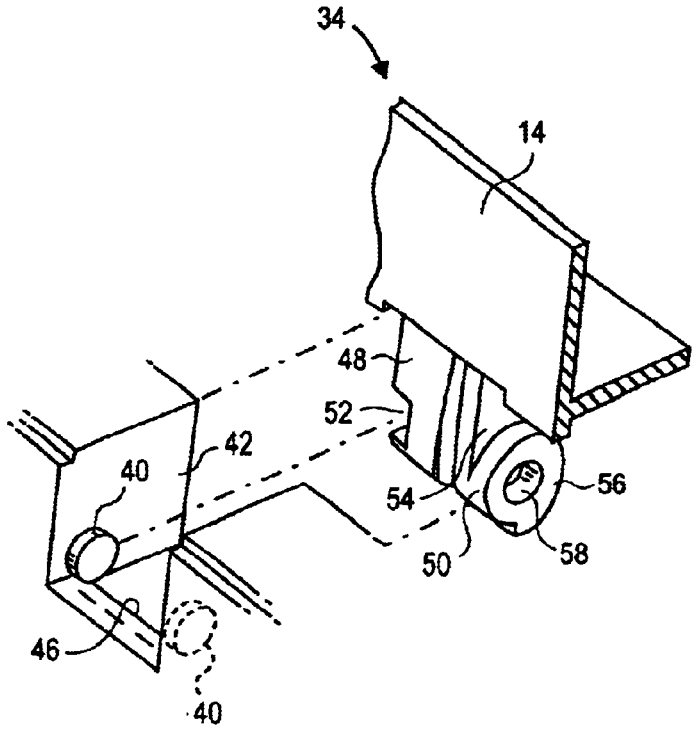
FIG. 3 is an exploded view of a snap hinge for use within containers of the invention.

FIG. 3 illustrates the second type of hinge, the "snap hinge" 34, which has the added function of retaining the side walls 14, 16 against removal from the pallet base 12. As shown in the figure, the snap hinge is also molded integrally with the side or end wall structure with its inside surface flush with the inside face of the wall. The hinge has a two part body comprising the body members 48 and 50. The body member 48 is similar to one side of the body 36 of the simple hinge member 32 in that it contains an open ended slot 52 which is designed to receive one of the hinge bosses 40 located in the U-shaped opening 42 in the adjacent base side wall 24 or end wall 26. The pivotal axis provided by the bosses 40, of course, coincides with the axis of the bosses of the adjacent simple hinge. The first hinge body member 48 functions in the manner described for the hinge body 36 of the simple hinge to provide a hinge point, and also includes a protrusion (not shown) for engagement with the shoulder 46 in the opening 42 of the adjacent base wall. This engagement prevents the side wall or end wall from being pivoted beyond the vertical position and also provides impact protection for the associated hinge boss.

The second body member 50 of the snap hinge 34 has a relatively thin walled shank 54 terminating in a cylindrical hub 56 which is provided with a bore 58 for receiving one of the bosses 40. Since the shank of the second hinge body member is somewhat flexible, it may be deformed to such an extent as to allow the corresponding boss 40 to engage the bore of the hinge member and to snap the remaining part of the hinge into engagement with the oppositely facing boss. With the snap hinge thusly engaged with the bosses, the associated container wall is held in removable attachment with the pallet base.

In certain preferred embodiments of the invention, cleaning of the hinge elements is facilitated by providing self-bailing hinge pockets 59 molded into the wall 24, 26 of the bases. By steeply inclining the floor of the hinge pocket downward as shown in FIG. 1, the hinge pocket drains readily during washing and has a greater tendency to shed contaminants during use of the container.

Figure 4:
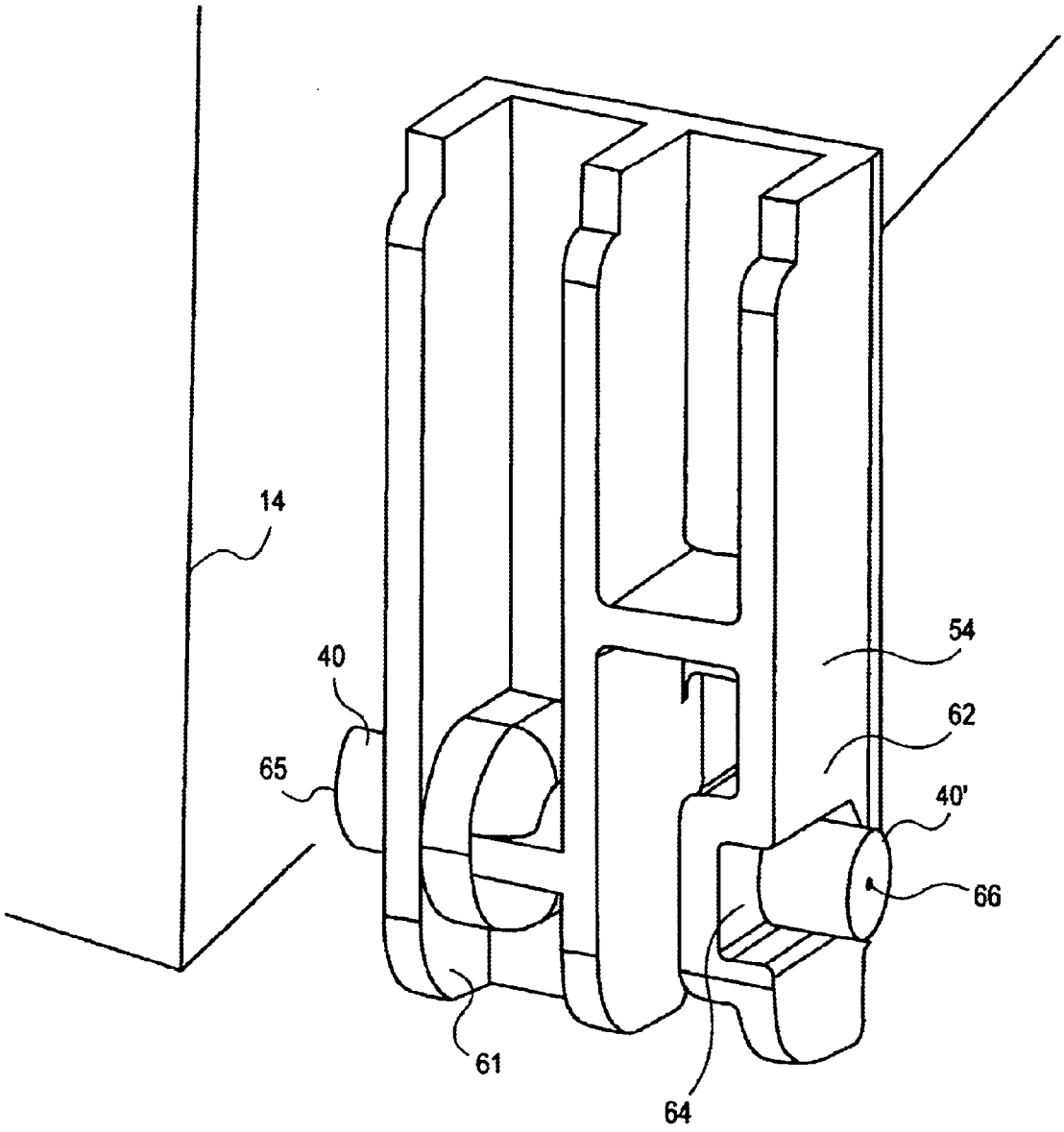
FIG. 4 is a perspective view illustrating a floating cantilever hinge of the invention.
Figure 5:
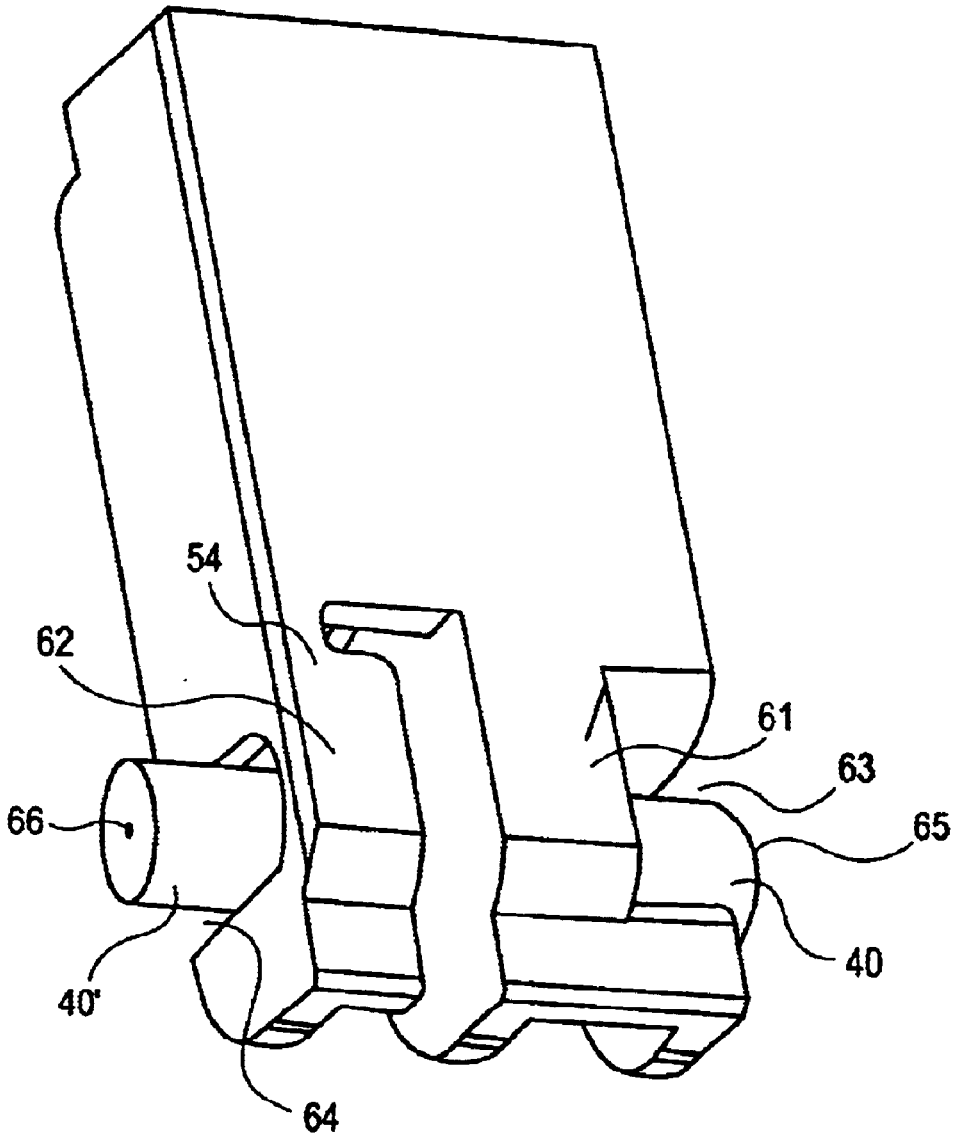
FIG. 5 is a perspective view illustrating a floating cantilever hinge of the invention.
Figure 6A:
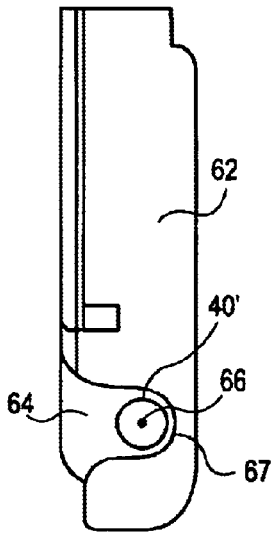
FIG. 6 is a schematic series of plan views illustrating relative movement of components within a floating cantilever hinge of the invention during collapsing of the container.
Figure 6C:
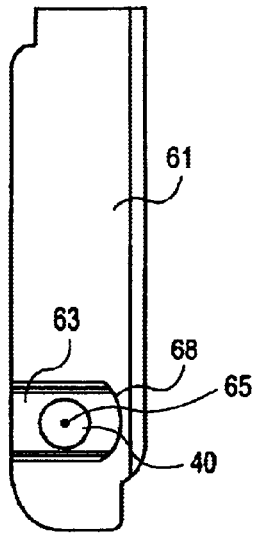
Figure 6B:
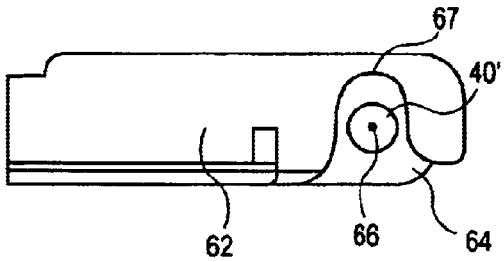
Figure 6D:
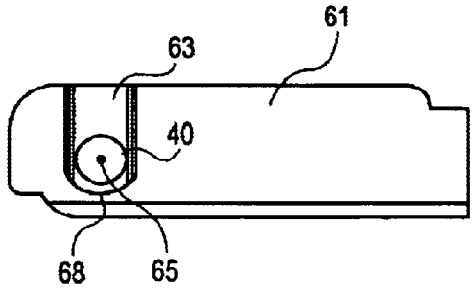

In other preferred embodiments of the invention, a modified snap hinge is provided which comprises a floating cantilever hinge 60 (see FIGS. 3–5). The purpose of this novel hinge design is to allow side walls 14, 16 and end walls 18, 20 that have been manufactured to different size specifications to be mounted to the same base 12 unit. In one example, a smaller side wall may be fitted to a base designed to precisely accommodate a slightly larger wall—which may require moving the side wall inward on the base. In this and other situations, the inner bottom surface of the side wall may impinge during folding on an edge of an opposing side wall causing stress on the side wall and upward motion on the hinge. To address these and other situations, a novel hinge is disclosed herein which is able to "float" when the side wall is folded in order to accommodate forceable upward movement of the inner, bottom edge of the side wall impinging against a non-yielding surface.

Briefly, as shown in FIG. 4, the floating cantilever hinge 60 of the invention features a modified "snap hinge" design. As with the above-described hinge designs, the floating cantilever hinge is molded integrally with the side wall 14, 16 or end wall 18, 20 structure. As with other snap hinges, the hinge has a two part body comprising first and second body members 61 and 62. The first and second body members each contain an open ended slot 63, 64, respectively, which is designed to receive one of the hinge bosses 40, 40' located in the U-shaped opening 42 in the adjacent base side wall 24 or end wall 26. Notably, the present hinge design features the two open slots for receiving the boses configured in opposite, inward- or outward-facing, orientations. This opposing slot configuration functions to retain the side walls in an attached position relative to the base. As in the case of the above-described snap hinge design, the present hinge includes a narrow shank connecting the second body member to the rest of the side wall which is somewhat flexible, whereby it can be deformed to to allow the corresponding boss 40' to engage the slot of the hinge member and to snap the remaining part of the hinge into engagement with the oppositely facing boss. With the snap hinge thusly engaged with the bosses 40, 40', the associated container wall is held in removable attachment with the pallet base.

In conjunction with the foregoing novel hinge design, the base 12 is modified by a relative change in height positions between the first boss 40 and second boss 40'. In certain embodiments, a center point 65 of the first boss is positioned lower in height, typically between about 0.10–0.40 inches and preferably about 0.25 inches lower, than a center point 66 of the second boss. This design allows for "floating" movement of the hinge when the side wall 14, 16 or end wall 18, 20 is being folded, as depicted in FIG. 6. The Figure, which schematically depicts on the left (panels A and B) and right (panels C and D) opposing plan views (i.e., views facing the sides of the second body member 62 and first body member 61, respectively) clearly illustrates the floating movement of the hinge, e.g., as illustrated by the extend of "play" between the relative positioning of the center 66 of the second boss 40' and end wall 68 of the second open-ended slot 64. Comparable play, but in an inverse relationship, is afforded for the first boss 40 in the first open ended slot 63, such that at all times one of the bosses 40, 40' is closely justaposed to its corresponding slot end wall 67, 68.

Figure 7:
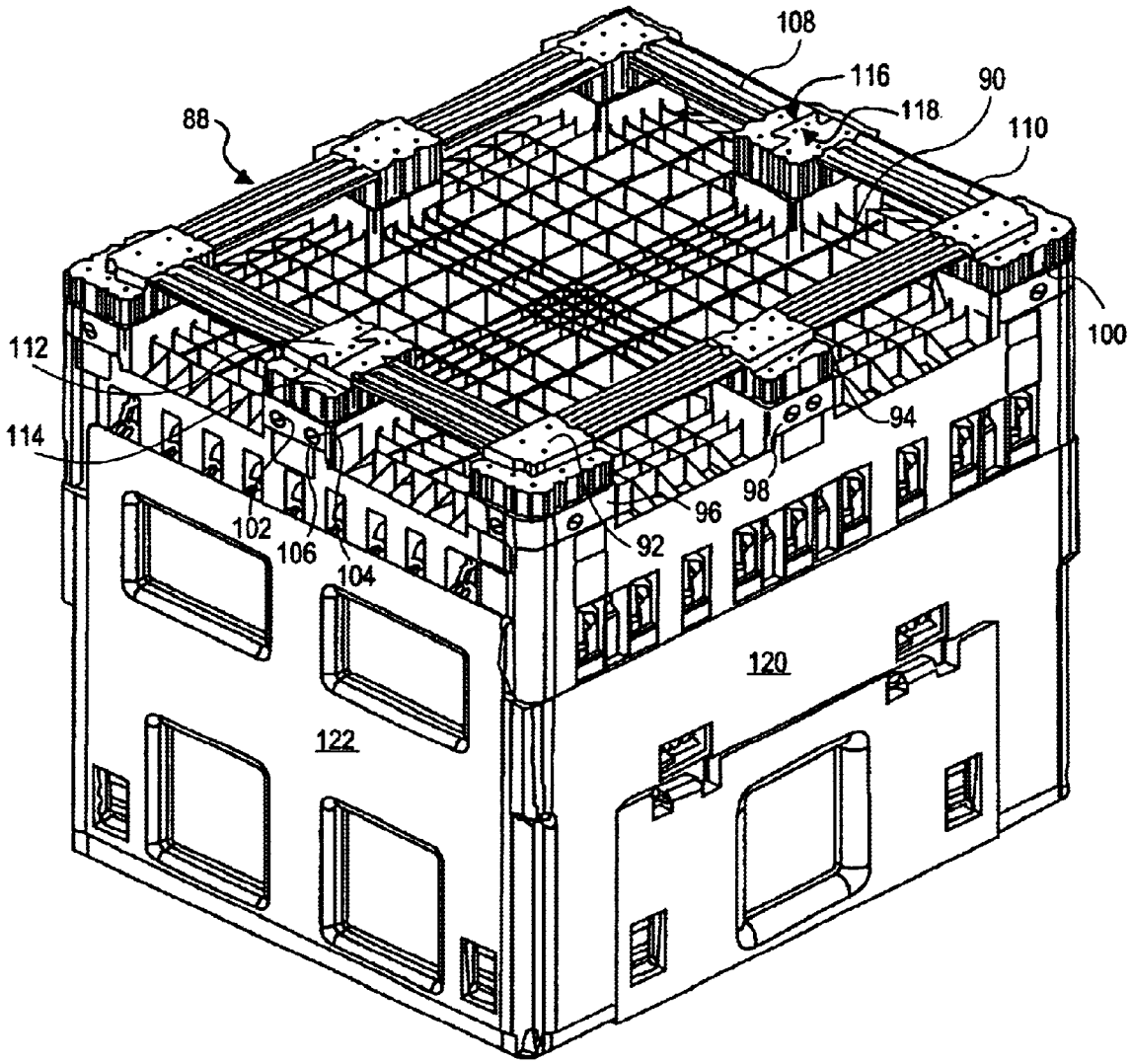
FIG. 7 is a perspective view, illustrating a container and container base with forklift strap constructed according to the concepts of the invention.

The base 12 unit for use with the collapsible container 10 of the invention may be constructed in a variety of forms and according to different specifications, substantially as described in the above-incorporated references. Typically, the base unit includes a smooth upper surface or container floor defined at its perimeter by the base side walls 24 and base end walls 26 that rise vertically from the base floor to support the side walls 14, 16 and end walls 18, 20, respectively (see FIG. 1). An optional feature of the container base 12 for use with the collapsible container 10 of the invention is a forklift strap 88 to prevent tipping of the container on a pair of lift forks when the container is raised from a seated or stacked position (see FIG. 7). In addition, the forklift strap provides strength and stability to the container.

Preferably, the forklift strap 88 has a square or rectangular shape that generally matches or parallels a perimeter outline of the underside 90 of the base 12. The strap is comprised of corner leg cap elements 92 and preferably also center leg cap elements 94 that seat telescopingly within corner and center bottom leg openings 96, 98, respectively. Each of the cap elements is sized and dimensioned for close receipt within the leg openings and has a perimeter flange 100 to support the base and effectively seal the base openings to further prevent dirt or grime from being lodged within the hollow base legs. The strap is preferably secured to the base by mounting pegs 102 that protrude laterally from the bottom portions of the base legs and are received in corresponding holes 104 in the leg caps of the strap when the strap is snap-fit onto the base. For ease of strap removal, the heads 106 of the mounting pegs are pre-tapped to align a drill to bore out the pegs for strap removal and replacement.

Figure 10:
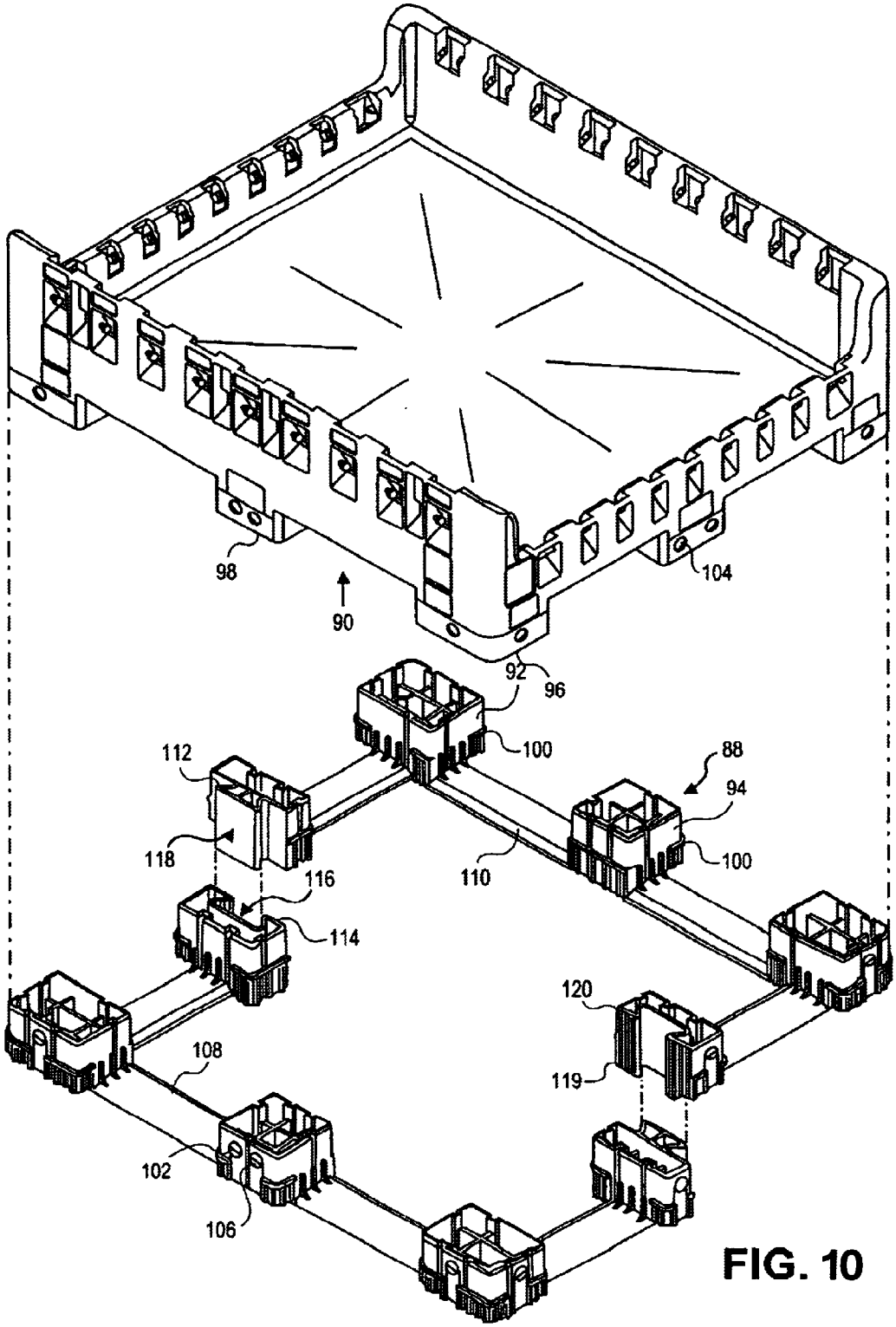
FIG. 10 provides an exploded isometric view illustrating the multi-component forklift strap.

In more detailed aspects of the invention, the optional forklift strap 88 for connection to the base 12 unit of the container 10 is provided as a multi-part component. Preferably, as shown in the embodiment depicted in FIGS. 7 and 10, the strap is composed of first and second, mated strap elements 108, 110, respectively. The two strap elements are interchangeable in construction, which provides substantial cost and labor advantages in the event of strap damage and replacement. The interchangeable strap elements, comprising opposing halves of a complete rectangular strap, are matingly joined, for example by interlocking dove-tail connector ends 112, 114 juxtaposed along a longitudinal midline of the base. In order to make the two strap halves of similar or identical construction for interchangeability, a novel draft design has been engineered on the opposing faces (arrows 116, 118) of the dove-tail connector ends. To provide a conventional degree of draft on these interlocked faces to facilitate removal of the strap elements from the mold would require imposition of sidedness to the two strap elements, obviating their interchangeability or creating too much play in the dove-tail connection. To overcome this problem, a novel solution has been provided which involves molding the opposing faces of the dove-tail connector ends to have a multiplicity of draft angles on their surfaces. For example, a first area 119 of each dove-tail element has an angled draft for ease of removal from the mold, whereas a second surface 121 is provided with an approximately zero draft for close juxtapositioning and fidelity of interlocking with the opposing dovetail element. Preferably, the opposing faces of the dove-tail connector ends are ribbed, with grooved portions between the ribs having an angled draft and the top surfaces (e.g., comprised of vertical contact ridges on one of the opposing surfaces as shown) of the ribs having an approximately zero draft to mate closely with the top rib surfaces on the opposing dovetail element.

Turning now to the novel side wall 14, 16 and end wall 18, 20 construction of the collapsible container 10 of the invention, it is an important feature thereof that both the exterior surfaces 120, 122 and the interior surfaces 124, 126, respectively, of the side walls and end walls are substantially smooth and free of obstructions, protrusions and sharp recesses. By virtue of this construction, the side walls and end walls are easily cleaned, and damage to sensitive contents such as produce is minimized. In more detailed embodiments, these interior and exterior surfaces of the walls are formed without any raised ribbing or other externally protruding reinforcements which would tend to collect grime and dirt and impose an increased risk of damage to the container contents.

The side walls 14, 16 and end walls 18, 20 of the container 10 are manufactured according to a novel process to have a closed, double-walled construction. In more specific detail, each of the side and end walls are formed from two separately-molded, exterior and interior, panels corresponding in reference enumeration to the exterior surfaces 120, 122 and the interior surfaces 124, 126 of the side and end walls, respectively. Each exterior panel is sized and dimensioned for direct apposition and welding to a corresponding interior panel to form a single side wall or end wall that has a closed construction by virtue of continuous top, side and bottom seams, 130, 132, 134, respectively, annealing each of the top, side and bottom edges of the interior and exterior panels of the side and end walls to the corresponding edges of the opposing panel. Annealing of the panels together in this manner to create a closed, dual-paneled construction to each wall of the container may be achieved by a variety of methods, including gluing and welding. Preferably, the side and end walls are constructed by hot plate welding the interior and exterior panels together along at least their entire top, side and bottom edges to form permanent seams 130, 132, 134 that are resistant to rupture and separation.

Figure 8:
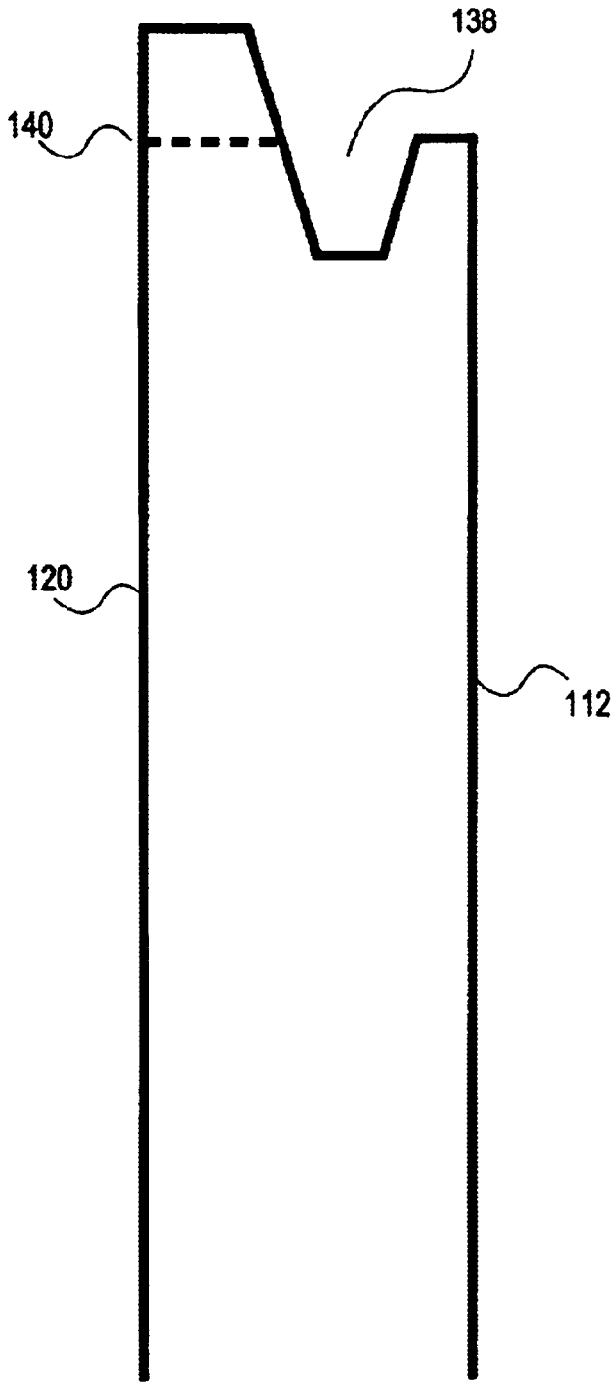
FIG. 8 is a schematic view of a wall panel end segment depicting a flash trap for hot plate welding of a container side or end wall element.
Figure 9:
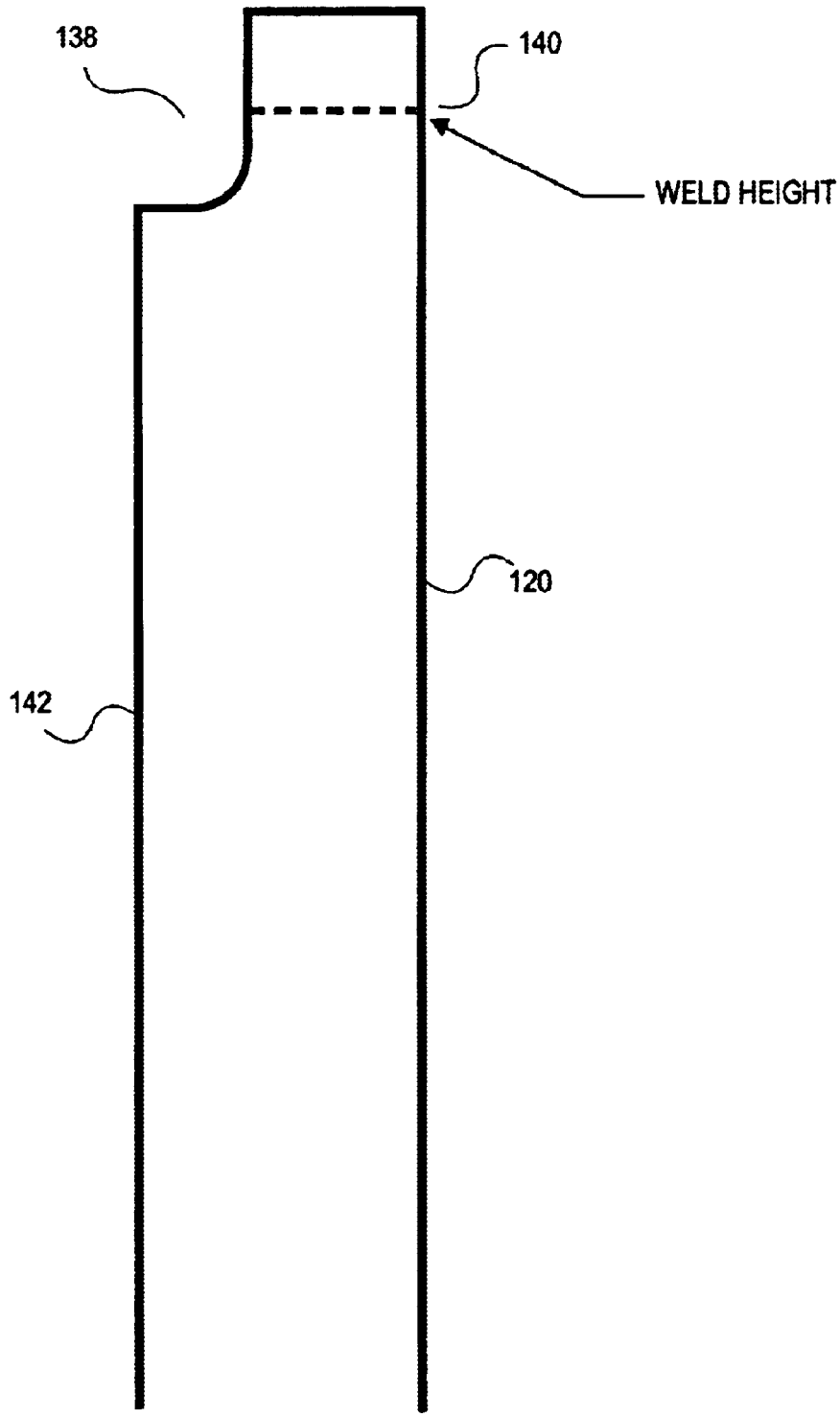
FIG. 9 is a schematic view of a wall panel end segment depicting an alternate flash trap for hot plate welding of a container side or end wall element.

In more detailed aspects of the invention, the side walls 14, 16 and end walls 18, 20 of the container 10 are provided with one or more flashless seams. Preferably, each wall has a flashless seam at least along its top edge to improve sanitation and prevent scraping of the user and/or goods along a flashed edge during loading or emptying of the container. To achieve this novel construction, at least one of the exterior panels 120, 122 and interior panels 124, 126 of each of the side and end walls is provided with an integrally molded v-shaped or notched flash trap 138 along its top edge (e.g., adjacent to top seam 130). As illustrated in FIGS. 8 and 9, the flash trap accepts excess molten thermoplastic material when the panel is heated and deformed down to a weld line for annealing to the opposing panel. For this purpose, the trap is disposed for receipt of excess flash material toward a hidden, internal surface 142 of each panel. In additional preferred embodiments, a flashless seam is also provided along the side edges of the walls, e.g., at side seam 132.

In additional detailed embodiments of the invention, the smooth side walls 14, 16, and end walls 18, 20 of the container 10 are provided with a windowed construction, which reduces materials expense and weight of the container and further enhances the esthetic value of the smooth-walled, flashless seam side wall design described above. To achieve this construction, at least one window 150 is formed within one or more of the side walls and/or end walls of the container. Preferably, each side and end wall includes at least one, preferably at least two, and most typically four or more separate windows integrally formed within the wall. The windows are displaced from the top, side and bottom seams 130, 132, 134 and are outlined by a separate, welded or glued window junction or seam 152 between opposing interior and exterior panels, 120, 122 and 124, 126, respectively.

Typically, the window seam 152 comprises a continuous square, rectangular, circular or oval hot plate-welded joint between the interior or exterior panels. Typically, the exterior panel 120, 122 is cut out along the window seam and is welded to the interior panel, 124, 126 which is continuous across a flat, single panel area 160 of the window. In preferred embodiments, a flash trap according to the above description is provided on at least one of the interior and exterior panels that runs continuously along the window seam to provide a flashless seam on the window for sanitary and esthetic purposes. In more detailed aspects of the invention, the window has a deeply bullnosed external rim 164 which is molded into the exterior panel 120, 122, while the interior panel 124, 126 surrounding the flat, single panel area of the window is either completely flat adjacent the window seam 152 or bears only a shallow bullnose angling toward the exterior panel.

There is a desire to achieve high load absorption capacity within certain areas of the container 10. Carrying structures made of materials such as concrete and steel will be able to withstand substantially the same load, independent of temperature and time. This is not the case with thermoplastic materials, where a relatively light load might cause a remaining deformation at extended exposure. This phenomena is called creep strain or cold flow. A structure made of thermoplastic material will however be able to cope with loads that are tens of times higher at shorter times, without any remaining deformation. The amount of cold flow in respect of time and temperature depends on thermoplastic material type and quality. Load carrying thermoplastic products will most often have to be designed for the most unfavorable load, i.e. longest time and highest temperature it might be exposed to during its useful life. It is, however, possible to reduce the amount of cold flow by adding fillers or reinforcing fibres to the thermoplastic material. Common fillers for use within the invention include minerals such as lime or mica while reinforcing materials include glass fibre, steel fibre, carbon fibre, and the like. It is also possible to reinforce thermoplastic materials for use within the invention by integrating a metal design in the container. This may, for example, be achieved by integrating metal rods or sheets in a hollow chamber, for example between exterior panels 120, 122 and interior panels 124, 126 of the side walls 14, 16.

As described above, the side walls 14, 16 of the collapsible container are suitably constituted of an inner and an outer layer between which one or more cavities are arranged. One or more reinforcing bars can be readily interposed within the cavities. Such a bar may, for example, be made of metal such as aluminum or steel, but may also be made of a thermoplastic material such as a polyolefin or polyamide, which can in turn be optionally reinforced with fibrous material, such as glass fibre, carbon fibre or aramide fibre. It is also contemplated to use wood as a reinforcing element in the cavities. The cavity or cavities may also be filled with an expanded polymeric material with an average density in the range 50–500 kg/m$^3$. The expanded material is suitably comprised of a polyurethane, polyolefin or like polymer. Filling with expanded polymeric material may be selected as a complementary reinforcing method to reinforcing bars, or as an alternative thereto.

Side walls 14, 16 of the collapsible container according to selected embodiments of the invention can be provided, for example, by manufacturing the exterior panels 120, 122 and interior panels 124, 126 separately by means of injection molding of a thermoplastic material. The panels are then joined after the injection molding by means of welding, by use of screws or rivets, by being snap-joined, or by other suitable joinder method. The exterior and interior panels may alternatively be molded simultaneously by means of vacuum molding of extruded thermoplastic sheets. The sheets are welded with each other in connection to the molding, while the thermoplastic material is still hot. This method is commonly known as twin-sheet molding. It is also possible to manufacture the interior and exterior panels as a monolitical unit by means of blow molding of a thermoplastic material. By each of the foregoing methods it is possible to achieve side walls with mainly smooth and planar inner faces.

Collapsible 10 containers according to the present invention are preferably, for their primary structural parts, made of one or more polymeric materials selected from the group consisting of polyethylene, polypropylene, polybutene, poly-vinylchloride, polyalkylene-therephtalate, akrylnitril-butadiene-styrenecopolymer, polyamide, polykarbonate or the like. They are suitably manufactured by means of injection molding, vacuum molding, blow molding, press molding or combinations thereof. The desired mechanical properties may vary between the different parts the container is made of. It is possible to add different substances to the thermoplastic material in order to improve or change these properties as desired. For example, ethyl-vinyl-acetate or rubber beads can be incorporated which will make the material more ductile and impact resistant. Glass fibre, carbon fibre, steel fibre or aramide fibre can be incorporated to make the material more rigid, less inclined to cold flow, but at the same time more brittle.

The parts of the container 10 are suitably molded so that the polymer chain orientation coincides mainly between the layers that forms the parts to be joined. The reason for this is that the contraction of the thermoplastic material depends on the direction of the polymer chains. These polymer chains will be oriented during the molding. Even if the main part of the contraction will take place within a couple of days, some additional contraction will occur during the main part of the useful life of the container. This contraction will be accelerated when the product is exposed to increased temperatures, such as for example during washing and drying. This contraction might cause bimetal-like warping of the product in cases where the polymers in the layers aren't oriented in similar manner. Such warping will most certainly increase as the product ages. The post-shrinking of different parts is for the same reason controlled so that all parts included in one and the same load carrier is in mainly the same degree of contraction. This can be achieved in different ways. One way is to allow the parts to shrink so that at least 75% of the total contraction is obtained. This can be achieved by an intermediate storing of the parts from a couple of hours to a couple of days before the next step in the process is started. It is here important that the different parts have the same degree of contraction. The contraction can be accelerated by letting the intermediate storing take place in an elevated temperature, for example 60–100° C. It may, however, be necessary to cool the parts before the joining as some stability may be required. The parts may otherwise be deformed by the handling during the joining.

Another way to solve the contraction problem is to "freeze" the different parts directly after each step of the process which involves thermoforming. This is suitably achieved by rapidly cooling the parts to below room temperature immediately after the molding. The contraction will then stop almost completely and will not commence until the parts are re-heated. It is also possible to mold and assemble all parts at predetermined junctures in the beginning of the contraction, for example when only 5–10% of the total contraction is obtained. The welding of the side wall parts can for example take place 1 minute±5 seconds after the molding of the parts.

Certain parts of the container 10, for example the exterior panels 120, 122 and interior panels 124, 126, are preferably joined with each other by means of welding, such as mirror welding, laser welding, friction welding and/or filler rod welding. Mirror welding is performed by heating two surfaces of thermoplastic material until it melts. The heating is performed by means of a so-called weld core which is a plate made of metal. The heated thermoplastic surfaces are then pressed together while the molten material is allowed to cool. When laser welding is used, one of the layers is at least somewhat translucent while the other one is opaque, most often by adding carbon black to the thermoplastic material. The two layers are pressed together, whereby the surfaces to be joined are illuminated with a laser. The illumination is performed from the translucent side. The energy from the laser beam will be transformed into thermal energy when it hits the opaque layer, whereby it melts and the parts are joined by welding. When friction welding is used, the surfaces to be joined are rubbed against each other so that the material melts due to the friction heat. Commonly known friction welding methods are ultrasonic welding, low frequency welding and rotation welding. Welding with filler rod in thermoplastic materials is similar to its metal counterpart. The joining surface and the filler rod, which are made of the same thermoplastic material, are heated with a so-called hot air insufflator. The filler rod is pressed into the joint while the hot air beam is slowly moved along the joint. This method may also be used as a complement in combination with the ones mentioned above.

In additional preferred embodiments of the invention, one or more of the side walls 14, 16 and end walls 18, 20 may be provided with a suitable access door 170 similar to access doors described in the above-incorporated reference documents. The access door is preferably connected to the wall by means of snap hinges 34, and the bottom edge of the hinged door is provided with a lip (not shown) for engagement with an appropriate shoulder on the wall 14 to absorb any lateral loads on the door to protect the hinge members in the manner previously described. Also, the access door may be latched to the wall structure by means of slide latches mounted on the end walls. As in the case of the side and end walls, the access panel is preferably constructed with a closed, hot-welded, multi-paneled design with at least a top access door seam 172 provided with a flashless construction by means of a flash trap 138 on one or more adjacent panel edges. Also, the access door may be provided with a separate access door window 174 having a flashless window seam 152 as shown in FIG. 1 and generally described above for the side and end walls.

Yet another novel feature of the invention is a specially adapted side wall 14, 16 and end wall 18, 20 construction for interchangeable stacking between different containers 10. In particular, the walls of the instant container are optionally equipped with a multi-functional nesting surface along their top wall margins 180, 182, respectively, for stacking of different types of existing containers atop the container 10. Toward this end, the embodiment shown in FIG. 1 has at least one, deep base leg-nesting corner slot 184 recessed deeply below the top wall margins 180, 182 of each side and end wall. Preferably, the container walls also feature mid wall base leg-nesting slots 186. These slots are sized and positioned to receive base legs of a first container type. At the same time, the top wall margins are also provided with a more shallowly recessed shoulder 188 that is generally continuous between the base leg-receiving slots and is positioned and dimensioned to seat containers of a second type.

Although no top structure is illustrated, it will be obvious to those skilled in the art that a top structure may be provided for the container with the proper configuration for engaging the top edges of the erected ends and side walls. Since the lateral loads on the ends and side walls are absorbed by their novel interconnections, there will be no loads applied to the cover structure.

Although the present invention has been described by way of a preferred embodiment and certain variations and modifications, other variations and modifications can also be used, the invention being defined by the following claims.

What is claimed is:

1. A collapsible container comprising:

a base, including a floor portion forming the floor of the container, an opposing pair of side walls and an opposing pair of end walls, each of the side walls and end walls having an exterior panel and an interior panel joined along top, side and bottom seams to form a closed, multi-paneled side or end wall, a multi-part forklift strap attached to the container base, said strap comprising two interchangeable strap halves, wherein the two interchangeable strap halves comprise interlocking dove-tail connector ends having opposing faces feature multiple drafted surfaces.

2. The collapsible container of claim 1, wherein the side or end wall incorporates a windowed construction having a window seam surrounding a single panel window area.

3. The collapsible container of claim 1, wherein the interior and exterior panels are joined by a process of welding.

4. The collapsible container of claim 1, wherein at least one of the top, side and bottom seams of the side or end wall is a flashless seam.

5. The collapsible container of claim 1, wherein at least one of the side walls or end walls incorporates a hinged access door having a closed, multi-paneled construction.

6. The collapsible container of claim 1, wherein the opposing faces of the dove-tail connector ends are ribbed, with grooved portions between the ribs having an angled draft and the top, opposing surfaces of the ribs having substantially no draft.

7. The collapsible container of claim 1, wherein an internal structural support member is integrated within one or more side walls of the container in a hollow chamber between exterior and interior panels of the side wall(s).

8. The collapsible container of claim 1 which incorporates a floating cantilever hinge design for interlocking the side and end walls to the base.

9. The collapsible container of claim 1, wherein the side and end walls are pivotally attached to the base by hinges incorporating self-bailing hinge pockets.

* * * * *